US008845313B2

(12) United States Patent
Graham et al.

(10) Patent No.: US 8,845,313 B2
(45) Date of Patent: Sep. 30, 2014

(54) OIL PUMP FOR AN ENGINE

(75) Inventors: Curtis John Graham, Peoria, IL (US); Adam William Ostein, Edelstein, IL (US); Patrick William Savage, Jr., Washington, IL (US); Christopher Lee Bach, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 217 days.

(21) Appl. No.: 13/299,488

(22) Filed: Nov. 18, 2011

(65) Prior Publication Data

US 2013/0125854 A1 May 23, 2013

(51) Int. Cl.
*F01C 1/18* (2006.01)
*F01M 1/02* (2006.01)

(52) U.S. Cl.
CPC ..... *F01M 1/02* (2013.01); *F01M 2001/0238* (2013.01)
USPC ..... 418/206.1; 418/132; 418/206.9; 184/6.21

(58) Field of Classification Search
USPC ..... 418/132, 206.1, 206.9; 184/6.21
See application file for complete search history.

(56) References Cited

U.S. PATENT DOCUMENTS

| | | | | |
|---|---|---|---|---|
| 1,719,025 | A | 7/1929 | Scheminger, Jr. | |
| 3,420,185 | A * | 1/1969 | Heijnis | 418/206.1 |
| 3,601,515 | A | 8/1971 | Pelizzoni | |
| 3,881,849 | A * | 5/1975 | Commarmot et al. | 418/182 |
| 4,093,407 | A * | 6/1978 | Miles | 418/15 |
| 6,557,455 | B2 | 5/2003 | Keyster et al. | |
| 6,814,044 | B2 | 11/2004 | Elliot et al. | |
| 2007/0098586 | A1 * | 5/2007 | Clark | 418/206.1 |
| 2010/0202913 | A1 * | 8/2010 | Shimamura | 418/206.1 |

FOREIGN PATENT DOCUMENTS

| | | | |
|---|---|---|---|
| FR | 627886 | A | 10/1927 |
| FR | 677462 | A | 3/1930 |
| FR | 2849102 | A1 | 6/2004 |
| GB | 697543 | A | 9/1953 |

* cited by examiner

*Primary Examiner* — Thai Ba Trieu
*Assistant Examiner* — Thomas Olszewski
(74) *Attorney, Agent, or Firm* — Miller, Matthias & Hull

(57) ABSTRACT

Embodiments of an oil pump for an engine have an increased pump capacity while maintaining or marginally increasing the overall physical size of the pump. In some embodiments, this increased capacity is reflected in a pump length efficiency ratio, which compares an effective gear length ($L_G$) of first and second pump gears used in the oil pump, to an effective housing length ($L_H$). The effective housing length ($L_H$) is a longitudinal distance between surfaces on opposite ends of the oil pump that must be maintained for the oil pump to fit into an available space. Accordingly, the pump length efficiency ratio indicates how much of the effective housing length ($L_H$) can be occupied by the gears. Alternatively, the pump capacity is measured using an output flow efficiency ratio, which compares a theoretical pump flow ($F_P$) at a given gear speed ($S_G$) to the effective housing length ($L_H$) of the pump.

17 Claims, 6 Drawing Sheets

G. 3

OIL PUMP FOR AN ENGINE

TECHNICAL FIELD

The present disclosure generally relates to lubrication systems for internal combustion engines and, more particularly, to oil pumps used in such engines.

BACKGROUND

Internal combustion engines require lubricating systems to lubricate moving parts and to remove heat. In large internal combustion engines for use in heavy duty machines and vehicles, an oil pump advances oil through the oil pump assembly components (such as an oil filter, oil filter base, and oil cooler) and distributes oil throughout the engine.

Heavy duty engines, such as truck engines, can experience low oil pressure conditions, especially later in service life. This low pressure is the result of the lubrication system lacking the capacity to absorb increased oil flow demands created by normal engine wear over the life of the engine. Such low pressure conditions, however, can negatively impact engine wear, engine cooling capacity, and overall engine performance. Consequently, engines experiencing low pressure conditions are often extensively refurbished, such as by replacing the engine block and/or crankshaft, at great expense.

While a larger capacity oil pump may be considered as a cheaper alternative to extensive refurbishment of the engine, this approach is made more difficult in a retrofit application, where a limited space is provided for the oil pump. In such applications, there may be critical dimensions that must be met so that the replacement pump will properly fit with the other engine components. These size limitations prevent the ability to simply increase the overall physical size of the oil pump, thereby making increased oil pump capacity difficult to obtain.

SUMMARY OF THE DISCLOSURE

In accordance with one aspect of the disclosure, an oil pump for an engine may include a pump housing having a pump chamber extending along a longitudinal axis, a front face defining an engine mounting surface disposed substantially along a first reference plane extending substantially perpendicular to the longitudinal axis, and a rear face including an inlet sleeve defining an inlet tube stop surface and an outlet sleeve defining an outlet tube stop surface. The inlet tube stop surface and the outlet tube stop surface are disposed substantially along a second reference plane extending substantially perpendicular to the longitudinal axis and substantially parallel to the first reference plane, wherein the second reference plane is spaced from the first reference plane by an effective housing length ($L_H$). A first pump gear is disposed in the pump chamber and operatively coupled to the engine, and a second pump gear is disposed in the pump chamber and operatively coupled to the first pump gear. The first and second pump gears engage along an effective gear length ($L_G$) extending substantially parallel to the longitudinal axis, and a pump length efficiency ratio of the effective gear length ($L_G$) to the effective housing length ($L_H$) is at least approximately 0.74.

In another aspect of the disclosure that may be combined with any of these aspects, the pump housing includes a pump body defining the front face and the pump chamber.

In another aspect of the disclosure that may be combined with any of these aspects, an oil pump for an engine may include a pump housing having a pump chamber extending along a longitudinal axis, a front face defining an engine mounting surface disposed substantially along a first reference plane extending substantially perpendicular to the longitudinal axis, and a rear face including an inlet sleeve defining an inlet tube stop surface and an outlet sleeve defining an outlet tube stop surface. The inlet tube stop surface and the outlet tube stop surface are disposed substantially along a second reference plane extending substantially perpendicular to the longitudinal axis and substantially parallel to the first reference plane, wherein the second reference plane is spaced from the first reference plane by an effective housing length ($L_H$). A first pump gear is disposed in the pump chamber and operatively coupled to the engine, and a second pump gear is disposed in the pump chamber and operatively coupled to the first pump gear, wherein the first and second pump gears have a theoretical pump flow ($F_P$) at a selected gear speed ($S_G$). The first and second pump gears are configured to produce an output flow efficiency ratio of the theoretical pump flow ($F_P$) to effective housing length ($L_H$) of at least approximately 0.27 gallons per minute at a gear speed ($S_G$) of approximately 1000 rpm.

In another aspect of the disclosure that may be combined with any of these aspects, the first and second pump gears engage along an effective gear length ($L_G$) extending substantially parallel to the longitudinal axis, and a pump length efficiency ratio of effective gear length ($L_G$) to effective housing length ($L_H$) is at least approximately 0.74.

In another aspect of the disclosure that may be combined with any of these aspects, the pump housing includes a pump body defining the front face and the pump chamber.

In another aspect of the disclosure that may be combined with any of these aspects, the pump body includes a body flange defining the front face, the body flange including an external shoulder portion having a rearward body flange face and a body flange internal portion defining a front wall of the pump chamber, wherein the body flange internal portion is disposed forwardly of the rearward body flange face.

In another aspect of the disclosure that may be combined with any of these aspects, the pump housing includes a pump cover removably coupled to the pump body and defining the rear face.

In another aspect of the disclosure that may be combined with any of these aspects, the pump cover includes a cover flange having a cover flange outer portion adapted for coupling to the pump body and a cover flange inner portion, wherein the cover flange inner portion has an exterior face formed with recesses to define the inlet tube stop surface and the outlet tube stop surface.

In another aspect of the disclosure that may be combined with any of these aspects, each of the first and second pump gears comprises a spur gear.

In another aspect of the disclosure that may be combined with any of these aspects, the first pump gear extends along a first gear axis, the second pump gear extends along a second gear axis, and each of the first and second gear axes is substantially parallel to the longitudinal axis of the pump chamber.

In another aspect of the disclosure that may be combined with any of these aspects, the pump housing is configured to withstand an oil pressure within the pump chamber of at least approximately 100 psi.

In another aspect of the disclosure that may be combined with any of these aspects, each of the first and second pump gears has an outer diameter less than or equal to approximately 52.5 mm.

DETAILED DESCRIPTION

Embodiments of an oil pump for an engine are disclosed in which the pump capacity is increased while maintaining or marginally increasing the overall physical size of the pump. In some embodiments, this increased capacity is measured using a pump length efficiency ratio, which compares an effective gear length ($L_G$) of first and second pump gears used in the oil pump, to an effective housing length ($L_H$). The effective housing length ($L_H$) is a longitudinal distance between surfaces on opposite ends of the oil pump that must be maintained for the oil pump to fit into an available space. Accordingly, the pump length efficiency ratio indicates how much of the effective housing length ($L_H$) can be occupied by the gears. Because effective gear length ($L_G$) also affects pump flow capacity, the pump length efficiency ratio also provides an indication of pump capacity for a fixed available pump space, and therefore is particularly useful in retrofit applications. For an oil pump used with an internal combustion engine, applicants have found that a pump length efficiency ratio of at least approximately 0.74 advantageously increases pump flow capacity while meeting the space limitations available for the pump.

In alternative embodiments, the pump capacity is measured using an output flow efficiency ratio, which compares a theoretical pump flow ($F_P$) at a given gear speed ($S_G$) to the effective housing length ($L_H$) of the pump. The theoretical pump flow ($F_P$) is determined primarily by the physical characteristics of the first and second pump gears, such as pump gear length and diameter, while the effective housing length ($L_H$) is the same as identified above. The output flow efficiency ratio indicates a flow capacity of a pump relative to the effective housing length ($L_H$). Accordingly, the output flow capacity is an alternative way to indicate pump capacity for a fixed available pump space, and therefore is also a useful factor when designing pumps for retrofit applications. For an oil pump used with an internal combustion engine, applicants have found that the output flow efficiency ratio of at least approximately 0.27 gallons per minute at a gear speed ($S_G$) of approximately 1000 rpm advantageously increases pump flow capacity while meeting the space limitations available for the pump.

Figure 1:
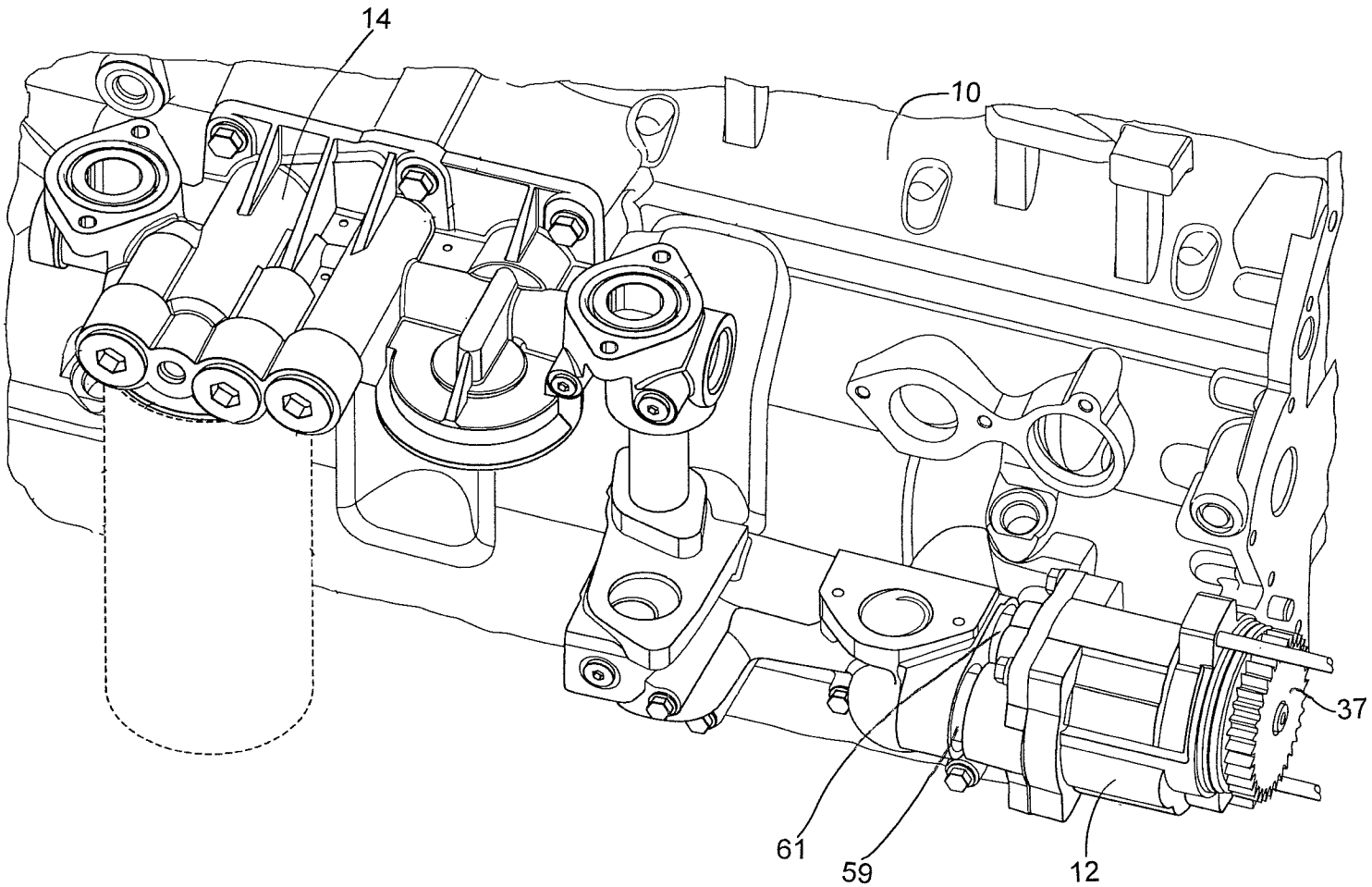
FIG. 1 is a partial perspective view of an engine block and lubricating system, including an oil pump, oil filter base and oil filter.

Referring now to FIG. 1, a lubricating system is shown mounted to an engine block 10 of an internal combustion engine, comprising an oil pump 12, oil filter base 14, and an oil filter (shown in phantom lines). The oil pump 12 forces oil from the engine block 10 into the oil filter base 14 and up through an oil cooler (not shown) mounted on the oil filter base 14. After cooling, the oil re-enters the oil filter base 14 and passes through the oil filter before re-entering the oil filter base 14 once more on its way back to the engine block 10.

Figure 6:
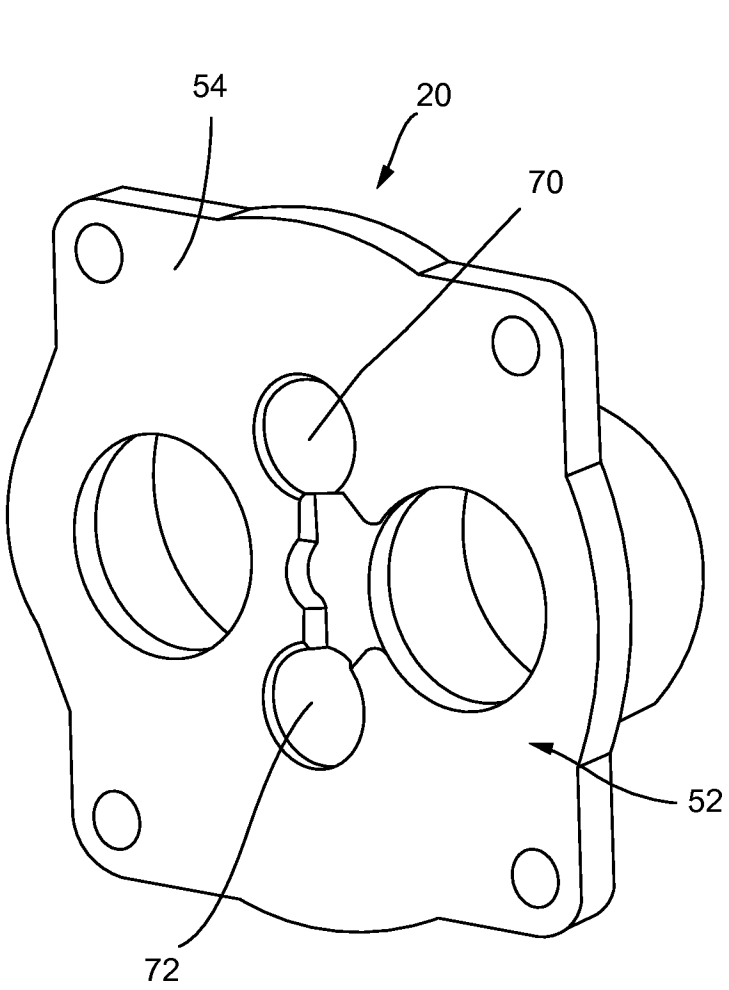
FIG. 6 is a rear perspective view of the pump cover of FIG. 5.
Figure 8:
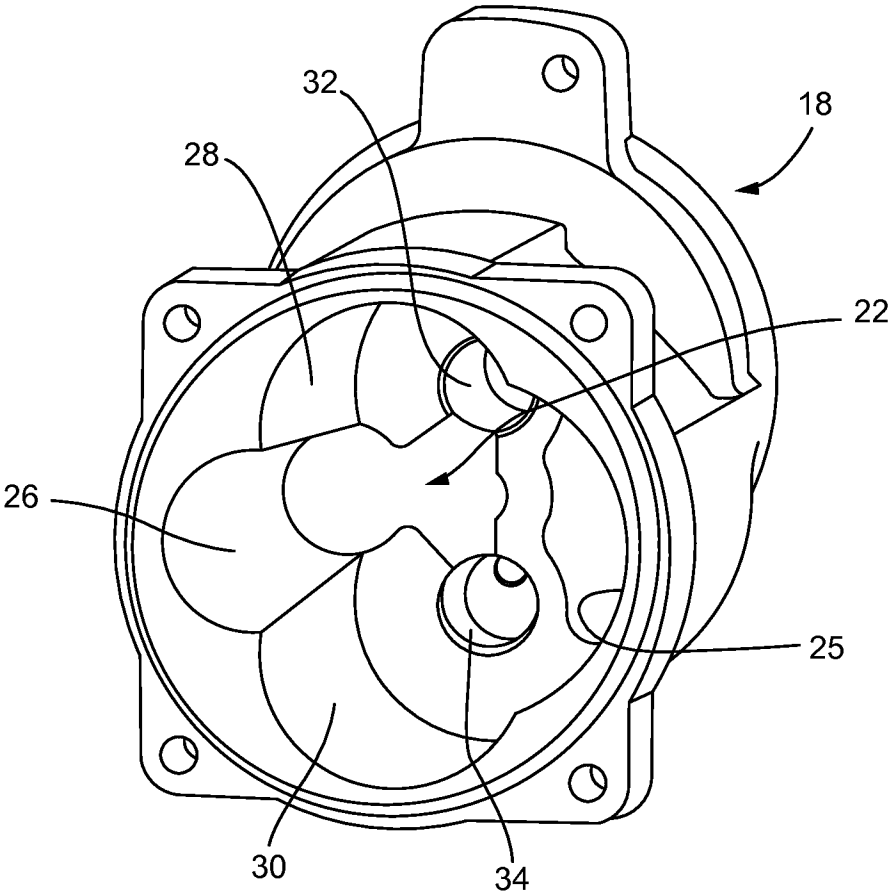
FIG. 8 is a rear perspective view of the pump body of FIG. 7.
Figure 7:
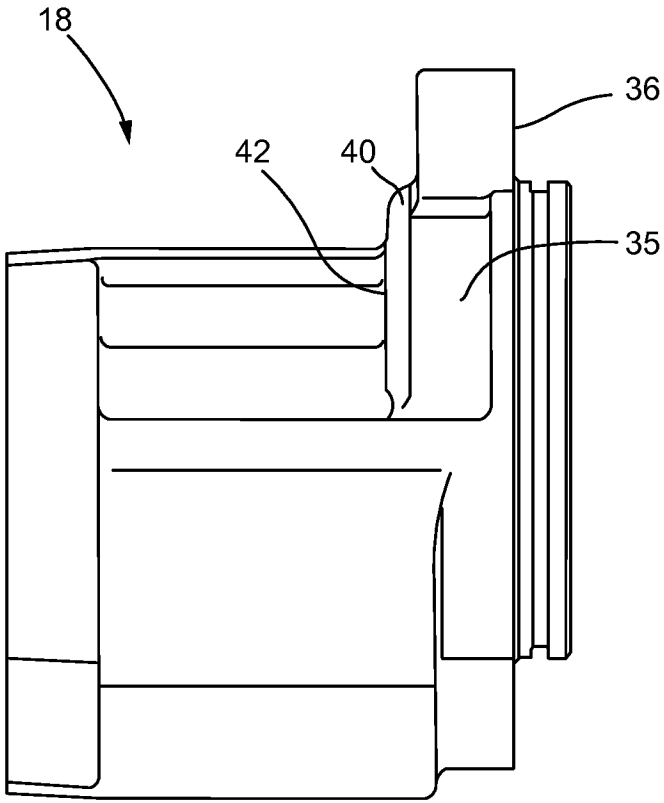
FIG. 7 is a side elevation view of a pump body for the oil pump of FIG. 2.

The oil pump 12, as shown in greater detail in FIGS. 2-8, includes a pump housing 16 which, in the illustrated embodiment, is formed by a pump body 18 and a pump cover 20. The pump housing 16 may define a pump chamber 22 defining a longitudinal axis 24. The pump chamber 22 may include an inlet cavity 25, an outlet cavity 26, and two gear cavities 28, 30 (FIGS. 7 and 8). A first shaft recess 32 and a second shaft recess 34 may also be formed by the pump chamber 22. The first shaft recess 32 may extend entirely through a body flange 35 of the pump body 18 to permit coupling to a drive gear 37, explained in greater detail below.

An exterior of the body flange 35 defines a front face 36 for mounting the oil pump 12 to the engine. The front face 36 is disposed substantially along a first reference plane 38 (FIG. 3) that extends substantially perpendicular to the longitudinal axis 24. The body flange 35 may further include an external shoulder portion 40 having a rearward body flange face 42 and a body flange internal portion 44. The body flange internal portion 44 may define a front wall 46 of the pump chamber 22.

Figure 4:
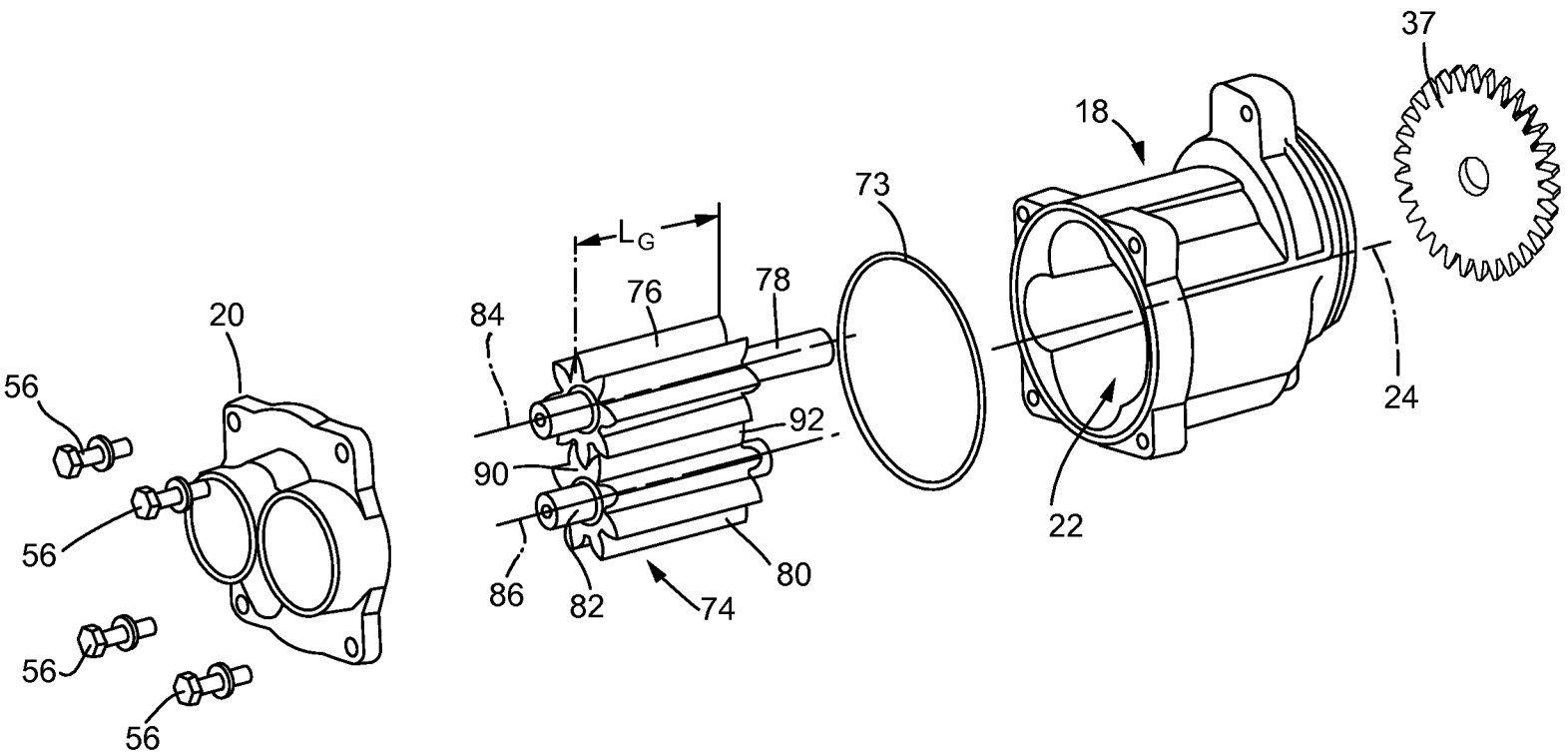
FIG. 4 is an exploded perspective view of the oil pump of FIG. 2.
Figure 5:
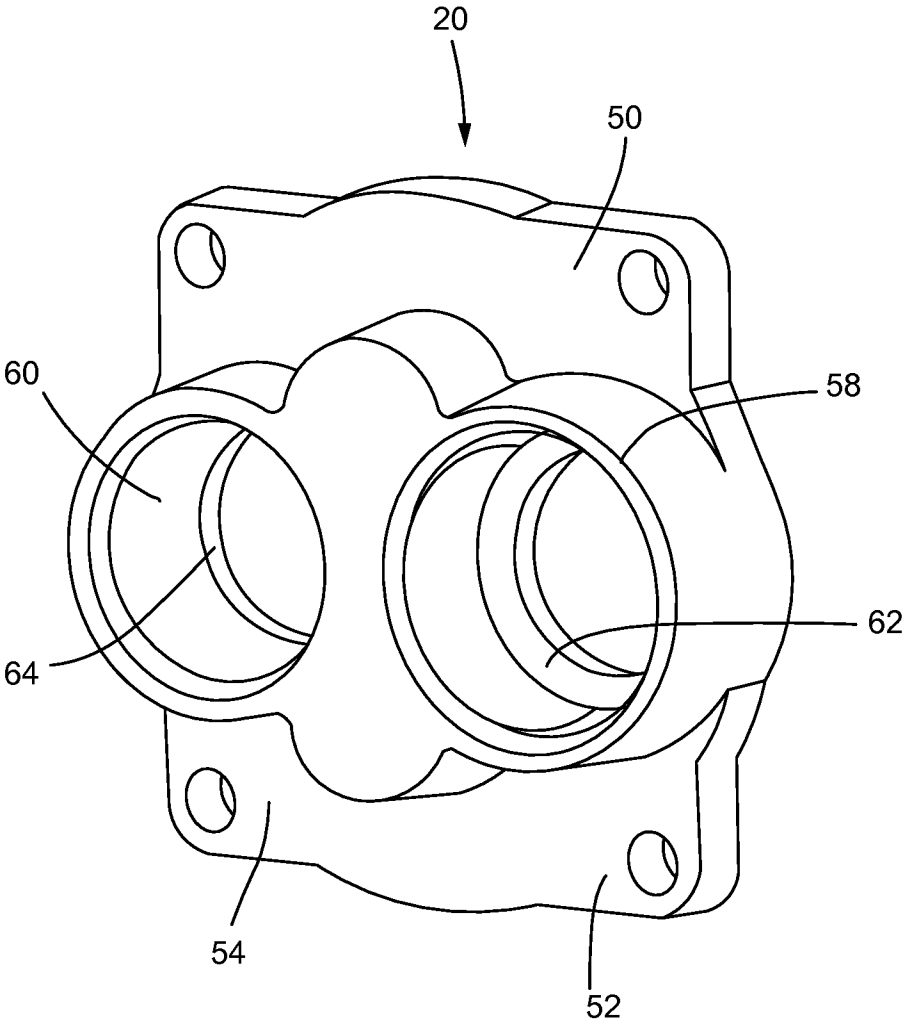
FIG. 5 is a front perspective view of a pump cover for the oil pump of FIG. 2.

The pump cover 20, best shown in FIGS. 5 and 6, provides a rear face 50 for the pump housing 16. In the illustrated embodiment, the pump cover 20 includes a cover flange 52 having a cover flange outer portion 54 adapted for coupling to the pump body 18, such as by fasteners 56 (FIG. 4). The rear face 50 is formed with an inlet sleeve 58 configured for coupling to an inlet tube 59 (FIG. 1) and an outlet sleeve 60 configured for coupling to an outlet tube 61 (FIG. 1). The inlet sleeve 58 includes an inwardly projecting inlet tube stop surface 62 and the outlet sleeve 60 includes an inwardly projecting outlet tube stop surface 64.

In the exemplary embodiment, a cover flange inner portion 66 (FIG. 3) has an exterior face formed with recesses that define the inlet tube stop surface 62 and the outlet tube stop surface 64. The inlet tube stop surface 62 and outlet tube stop surface 64 may be disposed substantially along a second reference plane 68 (FIG. 3) that extends substantially perpendicular to the longitudinal axis 24, and therefore is also substantially parallel to the first reference plane 38. An interior surface of the pump cover 20 defines a first shaft recess 70 and a second shaft recess 72 (FIG. 6). A rear seal 73 (FIG. 4) may be provided for sealing the engagement of the pump cover 20 to the pump body 18. In an exemplary embodiment, the pump housing 16 formed by the pump body 18 and pump cover 20 must be configured to withstand a maximum operating pressure of approximately 100 psi.

A pump gear assembly 74 is disposed inside the pump chamber 22 for drawing fluid in through the inlet sleeve 58 and discharging fluid out through the outlet sleeve 60. As best shown in FIG. 4, the pump gear assembly 74 includes a first pump gear 76 coupled to a first shaft 78 and a second pump gear 80 coupled to a second shaft 82. The first and second pump gears 76, 80 are shown as external spur gears. In an exemplary embodiment, each of the first and second pump gears 76, 80 has an outside diameter of approximately 52.5 mm.

The first shaft 78 has opposite ends disposed respectively in the first shaft recess 32 of the pump body 18 and the first shaft recess 70 of the pump cover 20, while the second shaft 82 has opposite ends disposed respectively in the second shaft recess 34 of the pump body 18 and the second shaft recess 72 of the pump cover 20. The first shaft 78 extends through the body flange 35 to permit coupling with the drive gear 37 (FIG. 3) which is in turn coupled to the engine, thereby operatively coupling the first pump gear 76 to the engine. The second shaft 82 is positioned so that the second pump gear 80 operatively engages the first pump gear 76. The first pump gear 76 may extend along a first gear axis 84 and the second pump gear 80 may extend along a second gear axis 86, wherein each of the first gear axis 84 and the second gear axis 86 is substantially parallel to the longitudinal axis 24 of the pump chamber 22 (FIG. 4).

Figure 2:
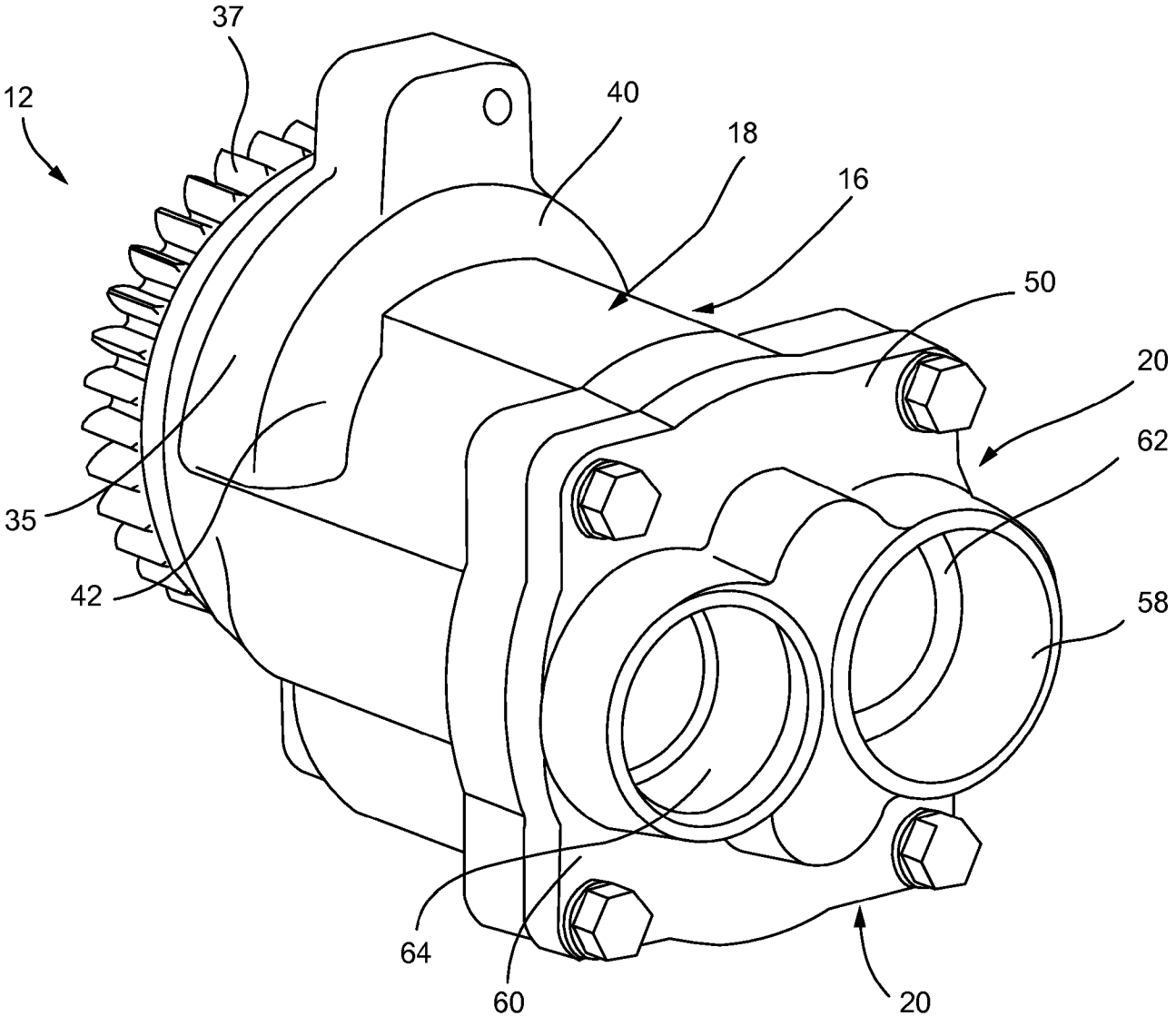
FIG. 2 is a perspective view of the oil pump of FIG. 1.

In operation, rotation of the first shaft 78 by the drive gear 37 causes rotation of the first pump gear 76, which in turn counter-rotates the second pump gear 80. Rotation of the first and second pump gears 76, 80 generates an oil flow path through the pump 12. More specifically, and referring to the orientation of the pump 12 as shown in FIGS. 2 and 4, oil enters the pump 12 through the inlet 58 to a right-side portion of the chamber 22. Oil in the right-side portion of the chamber 22 is drawn through the rotating pump gears 76, 80 and forced to a left-side portion of the chamber 22. Oil from the left-side portion of the chamber 22 is discharged through the outlet 60 to other components in the lubricating system.

Figure 3:
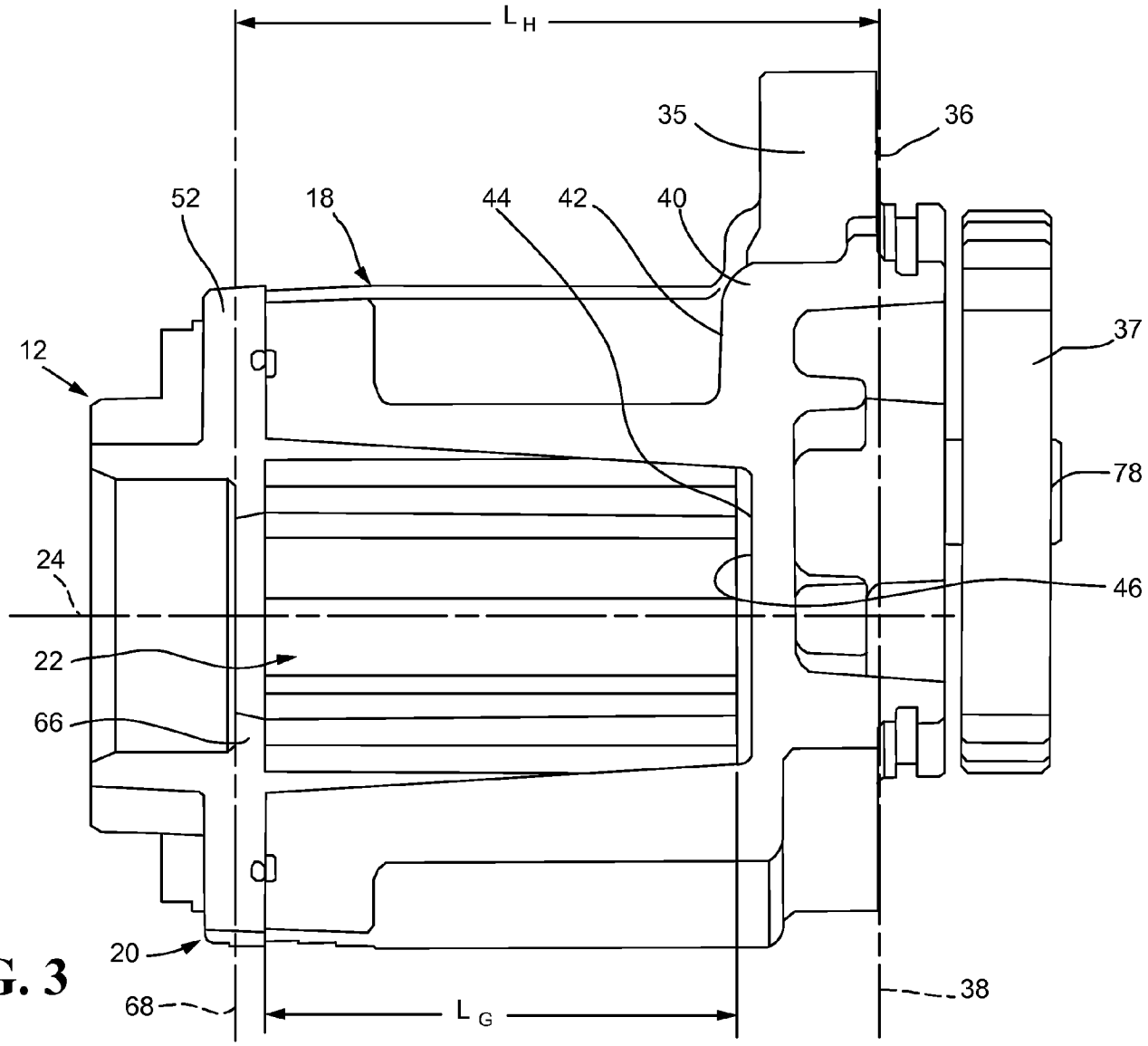
FIG. 3 is a side elevation view, in cross-section, of the oil pump of FIG. 2.

The oil pump 12 may have an effective housing length ($L_H$) which represents the longitudinal space between pump features that are used to interface with other lubrication system components located on opposite axial ends of the oil pump 12. In the illustrated embodiment, the front face 36 defines a surface that is mounted to the engine, and therefore is a pump feature on the front axial end of the oil pump 12 used to interface with the engine. The longitudinal location of the front face 36 is indicated by the first reference plane 38. The inlet and outlet tube stop surfaces 62, 64 provided on the pump cover 20 must be longitudinally positioned to couple with the inlet and outlet tubes 59, 61, and therefore provide a second interface located on the rear axial end of the oil pump 12. The longitudinal location of the inlet and outlet tube stop surface 62, 64 is indicated by the second reference plane 68. In the illustrated embodiment, therefore, the effective housing length ($L_H$) is the longitudinal distance between the first and second reference planes 38, 68, as best shown in FIG. 3.

The oil pump 12 may further have an effective gear length ($L_G$) which represents the longitudinal distance along which the pump gears are engaged. In the illustrated embodiment, the effective gear length ($L_G$) is the distance between a first axial engagement end 90 and a second axial engagement end 92 between the first and second pump gears 76, 80, as best shown in FIGS. 3 and 4.

The configuration of the first and second pump gears 76, 80 may determine a theoretical pump flow ($F_P$) at a selected gear speed ($S_G$). For example, the outer diameters of the first and second pump gears 76, 80, as well as the effective gear length ($L_G$) indicating the longitudinal length of engagement between the gears, may influence the volume rate of fluid that can be discharged by the oil pump 12. This theoretical pump flow ($F_P$) is further influenced by the rotational speed of the pump gears, and therefore a theoretical pump flow ($F_P$) has an associated gear speed ($S_G$).

INDUSTRIAL APPLICABILITY

Relationships may be developed between the above parameters that indicate the efficiencies associated with the oil pump 12. For example, a pump length efficiency ratio of the effective gear length ($L_G$) to the effective housing length ($L_H$) may indicate how efficiently the oil pump 12 uses the longitudinal space it physically occupies by indicating how much of the effective length can be used by the pump gears. Similarly, an output flow efficiency ratio of the theoretical pump flow ($F_P$) to effective housing length ($L_H$) may indicate how efficiently the oil pump uses the longitudinal space to produce output flow. These ratios may be used in retrofit applications, where the physical space in which the oil pump 12 may be placed is limited, to determine whether the oil pump 12 will meet the needs for a given application.

As an engine wears, an increased oil flow is needed to meet lubrication and cooling requirements. Instead of refurbishing the engine components (at great expense and effort), it may be possible to replace the original oil pump with a replacement oil pump having a higher flow output. The replacement oil pump, however, must still fit within the space envelope provided for the original oil pump. The exemplary oil pump embodiments described herein accomplish this by having a higher pump length efficiency and a higher output flow efficiency.

The following Table 1 is a comparison of specifications for an exemplary original oil pump and an exemplary replacement oil pump 12. As indicated by the greater effective gear length ($L_G$) at substantially the same effective housing length ($L_H$), the replacement oil pump 12 more efficiently uses the longitudinal space provided for the pump.

TABLE 1

| | Original Oil Pump | Replacement Oil Pump |
|---|---|---|
| Effective Gear Length | 67.5 mm | 81 mm |
| Effective Housing Length | 108.5 mm | 109.5 mm |
| Theoretical Pump Flow (at 1000 rpm) | 25 GPM | 30 GPM |
| Pump Length Efficiency Ratio | 0.62 | 0.74 |
| Output Flow Efficiency Ratio | 0.23 | 0.27 |

By more efficient use of the longitudinal space, the replacement pump was able to achieve an oil pressure of 25 psi at low idle, where the original pump could produce only 19 psi. The more efficient use of space in the replacement oil pump 12 may be attributed, at least in part, by forming recesses in the cover flange inner portion to define the inlet tube stop surface and the outlet tube stop surface. Additionally, in the replacement pump the body flange internal portion is disposed forwardly of the rearward body flange space. Both of these modifications accommodated additional longitudinal space for the pump gears. The increased effective gear length ($L_G$), in turn, permitted a higher theoretical flow output for the replacement pump, thereby to increase the pressure at low idle.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An oil pump for an engine, comprising:

a pump housing including:

a pump chamber extending along a longitudinal axis;

a front face defining an engine mounting surface disposed substantially along a first reference plane extending substantially perpendicular to the longitudinal axis;

a rear face including an inlet sleeve defining an inlet tube stop surface and an outlet sleeve defining an outlet tube stop surface, wherein the inlet tube stop surface and the outlet tube stop surface are disposed substantially along a second reference plane extending substantially perpendicular to the longitudinal axis and substantially parallel to the first reference plane, wherein the second reference plane is spaced from the first reference plane by an effective housing length ($L_H$);

a first pump gear disposed in the pump chamber and operatively coupled to the engine; and a second pump gear disposed in the pump chamber and operatively coupled to the first pump gear;

wherein the first and second pump gears engage along an effective gear length ($L_G$) extending substantially parallel to the longitudinal axis; and wherein a pump length efficiency ratio of the effective gear length ($L_G$) to the effective housing length ($L_H$) is at least approximately 0.74.

2. The oil pump of claim 1, in which the pump housing includes a pump body defining the front face and the pump chamber.

3. The oil pump of claim 2, in which the pump body includes a body flange defining the front face, the body flange including an external shoulder portion having a rearward body flange face and a body flange internal portion defining a front wall of the pump chamber, wherein the body flange internal portion is disposed forwardly of the rearward body flange face.

4. The oil pump of claim 2, in which the pump housing includes a pump cover removably coupled to the pump body and defining the rear face.

5. The oil pump of claim 4, in which the pump cover includes a cover flange having a cover flange outer portion adapted for coupling to the pump body and a cover flange inner portion, wherein the cover flange inner portion has an exterior face formed with recesses to define the inlet tube stop surface and the outlet tube stop surface.

6. The oil pump of claim 1, in which each of the first and second pump gears comprises a spur gear.

7. The oil pump of claim 1, in which the first pump gear extends along a first gear axis, the second pump gear extends along a second gear axis, and each of the first and second gear axes is substantially parallel to the longitudinal axis of the pump chamber.

8. The oil pump of claim 1, in which the pump housing is configured to withstand an oil pressure within the pump chamber of at least approximately 100 psi.

9. An oil pump for an engine, comprising:

a pump housing including:

a pump chamber extending along a longitudinal axis;

a front face defining an engine mounting surface disposed substantially along a first reference plane extending substantially perpendicular to the longitudinal axis;

a rear face including an inlet sleeve defining an inlet tube stop surface and an outlet sleeve defining an outlet tube stop surface, wherein the inlet tube stop surface and the outlet tube stop surface are disposed substantially along a second reference plane extending substantially perpendicular to the longitudinal axis and substantially parallel to the first reference plane, wherein the second reference plane is spaced from the first reference plane by an effective housing length ($L_H$);

a first pump gear disposed in the pump chamber and operatively coupled to the engine; and a second pump gear disposed in the pump chamber and operatively coupled to the first pump gear, wherein the first and second pump gears have a theoretical pump flow ($F_P$) at a selected gear speed ($S_G$);

wherein the first and second pump gears are configured to produce an output flow efficiency ratio of the theoretical pump flow ($F_P$) to effective housing length ($L_H$) of at least approximately 0.27 gallons per minute at a gear speed ($S_G$) of approximately 1000 rpm and wherein the first and second pump gears engage along an effective gear length ($L_G$) extending substantially parallel to the longitudinal axis, and in which a pump length efficiency ratio of effective gear length ($L_G$) to effective housing length ($L_H$) is at least approximately 0.74.

10. The oil pump of claim 9, in which the pump housing includes a pump body defining the front face and the pump chamber.

11. The oil pump of claim 10, in which the pump body includes a body flange defining the front face, the body flange including an external shoulder portion having a rearward body flange face and a body flange internal portion defining a front wall of the pump chamber, wherein the body flange internal portion is disposed forwardly of the rearward body flange face.

12. The oil pump of claim 10, in which the pump housing includes a pump cover removably coupled to the pump body and defining the rear face.

13. The oil pump of claim 12, in which the pump cover includes a cover flange having a cover flange outer portion adapted for coupling to the pump body and a cover flange inner portion, wherein the cover flange inner portion has an exterior face formed with recesses to define the inlet tube stop surface and the outlet tube stop surface.

14. The oil pump of claim 9, in which each of the first and second pump gears comprises a spur gear.

15. The oil pump of claim 9, in which the first pump gear extends along a first gear axis, the second pump gear extends along a second gear axis, and each of the first and second gear axes is substantially parallel to the longitudinal axis of the pump chamber.

16. The oil pump of claim 9, in which the pump housing is configured to withstand an oil pressure within the pump chamber of at least approximately 100 psi.

17. The oil pump of claim 9, in which each of the first and second pump gears has an outer diameter less than or equal to approximately 52.5 mm.

* * * * *